United States Patent [19]

Good

[11] 4,008,640

[45] Feb. 22, 1977

[54] SAW CHAIN ASSEMBLY

[76] Inventor: Albert E. Good, 102 High St., Ramsey, N.J. 07446

[22] Filed: Sept. 10, 1975

[21] Appl. No.: 612,189

[52] U.S. Cl. ..... 83/833; 83/834

[51] Int. Cl.[2] ..... B27B 33/14

[58] Field of Search ..... 83/833, 834, 831

[56] References Cited

UNITED STATES PATENTS

| | | | |
|---|---|---|---|
| 2,891,586 | 6/1959 | Wright | 83/834 |
| 2,928,440 | 3/1960 | Fors | 83/834 |

*Primary Examiner*—Donald R. Schran

*Attorney, Agent, or Firm*—Lerner, David, Littenberg & Samuel

[57] ABSTRACT

A saw chain assembly which requires a minimum of independently moving elements is disclosed in which the assembly includes a plurality of cutter links interconnected in the form of a chain by linking members. Each cutter link preferably comprises a unitary gear and cutting element. Each linking member comprises two substantially parallel side walls which are integrally connected by a bridge wall so as to form a channel between the side walls. The ends of adjacent links are disposed in the channel and hingedly connected to the side walls.

10 Claims, 4 Drawing Figures

SAW CHAIN ASSEMBLY

FIELD OF THE INVENTION

This invention relates to saw chain assemblies for use in power chain saws. More particularly, the invention relates to an improved saw chain assembly which requires a minimum number of independently moving elements. The invention also relates to an improved saw chain assembly wherein saw dust, splinters, and the like, are inhibited from clogging the saw drive means.

BACKGROUND OF THE INVENTION

Conventionally, saw chain assemblies for use in conjunction with powered chain saws have been constructed using a series of connected linking members some of which define cutting blades and others of which define gears or driving lugs to engage the drive mechanism of the saw to effect operation thereof. Typically, the individual links are connected by means of separate side links disposed on opposite faces of adjacent cutter and gear links.

Various prior art devices have decreased the number of working parts by combining the cutter blade and the gear into a single link member. Saw chains of this type are disclosed in U.S. Pat. No. 3,380,496 to Hill; U.S. Pat. No. 3,261,385 to Cooper; U.S. Pat.No. 3,269,434 also to Cooper; U.S. Pat. No. 2,852,048 to Cox; and U.S. Pat. No. 2,564,989 to Ohman. However, each of the disclosed saw chains requires that the two separate side links described above be used to connect adjacent combination cutter and gear links together. Further, the manner in which the side links are secured to opposite faces of the link members results in an open passageway between the links thus permitting saw dust, splinters and the like, which are produced as a result of the cutting operation, to find their way to the saw drive mechanism. Build-up of such substances on the drive mechanism as well as in the space between links can have an adverse effect on the functioning of the saw.

It is therefore an object of this invention to provide an improved saw chain assembly which prevents debris produced during sawing from building up on the chain saw drive mechanism and interfering with the operation thereof.

It is further the object of this invention to provide an improved saw chain assembly which reduces the number of independently moving parts required while increasing the efficiency of manufacture and operation as well as providing a longer working life for the assembly.

It is a still further object of this invention to provide an improved saw chain assembly which is quieter in operation than saw chains presently available.

SUMMARY OF THE INVENTION

The present invention relates to an improved saw chain assembly which requires a minimal number of independently moving parts while increasing efficiency of both manufacture and operation. The assembly comprises a plurality of individual cutter links which are interconnected in the form of a chain by linking members. Each cutter link preferably comprises a combined gear and cutting element, the gear being adapted to engage the drive mechanism of any conventional chain saw. Each linking member, which is hingedly connected to adjacent cutter links, comprises two substantially parallel side walls which are integrally connected by a bridge wall. The respective side walls and bridge wall of a given linking member form a channel between the side walls and extending the length thereof, and into which an end of each of two adjacent cutter links is disposed. The links are secured to the side walls by means of conventional link pins and the like. Thus, a total of only four working elements for each section of the saw chain are necessary, namely, a unitary linking element, a combined cutting edge-gear element, and a pair of rivets or link pins.

According to the present invention, the bridge wall which connects the parallel side walls of the linking member is preferably constructed such that when it is connected to adjacent cutter links no passageway exists from the upper cutting-edge portion of the chain to the drive mechanism of the saw. This substantially prevents the ingress of any debris produced as a result of the sawing operation from finding its way between the cutter links to the drive mechanism and thus prevents any impairment of function that may result therefrom. The bridge wall further acts as a running bearing surface which serves to maintain the saw chain in a proper path during sawing. It can thus supplement the function of a conventional depth gauge which may also be provided on the cutter link.

The novel linking members of the present invention greatly simplifies the manufacture of the saw chain assembly. Since the linking member actually comprises two side links which are integrally connected to each other by a bridge portion, it is only necessary that a single linking member blank be manufactured rather than two separate ones. Further, when the blank is folded so that two substantially parallel side walls and an integral bridge wall are formed, the integral bridge wall maintains the side walls at a predetermined distance from each other thus defining a channel between them. This feature readily facilitates disposing of an end of each of two adjacent cutter links in the channel and connection of the links by the linking members without the necessity of providing means for holding separate side links in proper alignment with each other and the cutter links to which they are to be secured. Similarly, holes which are provided on opposite ends of each of the respective side walls of a given linking member and on the cutter links themselves for reception of a suitable rivet or pin which secures the linking member to the cutter links, are easily maintained in proper alignment as a result of the integral construction of the linking member.

The structure of the linking member further serves to eliminate a substantial amount of shear force on the link pins which would normally result from relative movement of the linking members and cutter links thereto. Since both side walls move together, less shearing action occurs than where separate side links, which can move independently, are employed. Elimination of such shear forces greatly lengthens the working life of the assembly.

It has also been found that use of the integral unitary linking member results in much quieter operation of the chain saw thus benefiting both the operator thereof as well as the public at large. This fact is of particular importance today when elimination of noise pollution has become such a major concern of the public. While not wishing to be bound by any particular theory, it is believed that the quieter operation results simply from a decrease in the number of working parts which can move relative to each other, such decrease being effected by use of the integral unitary linking member structure.

DESCRIPTION OF THE DRAWINGS

For a more complete understanding of the invention, reference should be made to the following detailed description and drawings, in which.

DETAILED DESCRIPTION OF THE INVENTION

Figure 1:
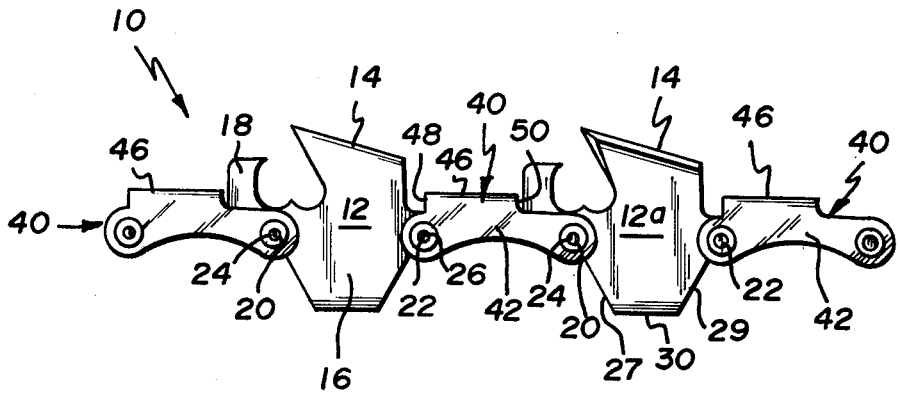
FIG. 1 is a side elevation of a portion of the saw chain incorporating the features of the invention.

Referring now to FIGS. 1, 2, and 4, 10 represents an improved saw chain made up of a plurality of right and left hand cutter links 12 and 12a, respectively. The cutter links are interconnected in the form of a chain by linking members 40.

Cutter links 12 and 12a are identical in all respects except that one is a right hand and the other a left hand cutter. In the preferred embodiment of the invention, the cutter link is formed of a flat body 12 or 12a the upper portion of which defines a cutting edge or a cutting tooth 14 and the lower portion of which defines a gear 16 which can engage the drive mechanism of a saw to which the saw chain is to be mounted. The cutter link is also provided at the upper portion thereof with a suitable depth gauge 18 which limits the depth of cutting of the cutting edge immediately associated therewith. Each cutter link is also provided with holes 20 and 22 which receive link pins 24 and 26, serving to hingedly mount adjacent linking members to a given cutter link. It will be appreciated by those skilled in the art that the present invention does not require that unitary cutting edge-gear links be employed but rather can be replaced, where desired, by links providing each of these respective functions separately. Further, where a unitary cutting edge-gear link is utilized, additional spacer links may be employed providing either or both of such functions. This will, of course, depend upon the particular cutting characteristics desired.

According to a preferred embodiment of the invention the gear element is constructed to provide maximum surface contact of the gear element with the chain saw drive mechanism thus eliminating slippage which can result in impaired sawing efficiency. This is accomplished by constructing the gear elements in virtually the same shape as the gear receptacles into which they are mounted. One specific construction is shown in FIG. 1 wherein the lower portion 16 of the cutter link 12 is defined by forward and rearward edges 27 and 29 of the cutter link and by lower edge 30. As will be appreciated by those skilled in the art, the particular construction will vary with the shape of the gear receptacles on a given chain saw.

Figure 2:
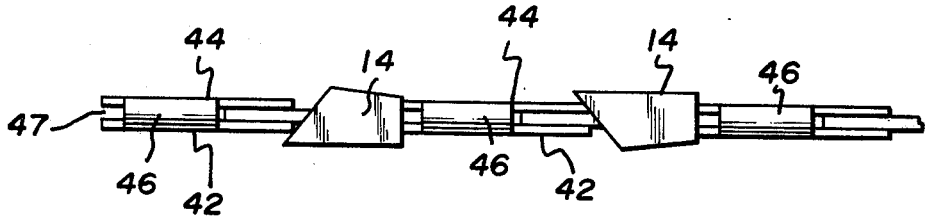
FIG. 2 is a top-plan view of a section of the saw chain shown in FIG. 1.
Figure 3:
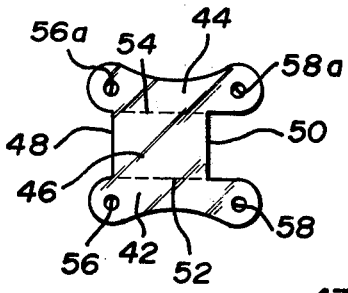
FIG. 3 is a top-plan view of a linking member blank from which the linking member of the present invention is formed.

As most clearly shown in FIG. 3, the novel linking member 40 of the present invention is formed from a blank and comprises two integrally connected side walls 42 and 44. The side walls are connected by a bridge wall 46 which is defined by edges 48 and 50 of the blank. The blank is formed into its final shape by folding at 52 and 54. It is folded in such a manner so as to align side walls 42 and 44 in substantially parallel planes while maintaining the bridge wall 46 in a plane approximately at right angles thereto. A channel is thus defined between the side walls 42 and 44 which extends the entire length thereof. As a result of the folding operation, holes 56 and 58, formed in each of the side walls respectively, are brought into direct alignment. Referring again to FIGS. 1, 2, and 4, it can be seen that linking member 40 is utilized to connect adjacent cutter links by disposing an end of each of two adjacent cutter links within the channel 47.

Holes 56 and 56a on the linking member are brought into alignment with hole 22 on a given cutter link and link pin 26 is placed therethrough to hingedly connect the linking member to the link. Similarly, holes 58 and 58a are brought into alignment with hole 20 on an adjacent cutter link and link pin 24 is placed therethrough to likewise hingedly connect the linking member to such adjacent link.

Figure 4:
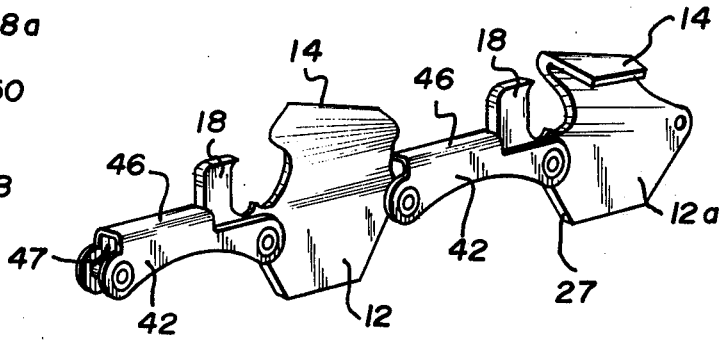
FIG. 4 is a perspective view of a portion of the saw chain incorporating the features of the invention.

As shown in FIGS. 1, 2 and 4, in a preferred embodiment of the invention, the linking member is constructed such that when it is connected to adjacent links, edges 48 and 50 thereof which define bridge wall 46 are substantially contiguous with the upper forward and rearward edges respectively of the links. Thus, the bridge wall and the links cooperate to substantially eliminate any passageway between the side walls. It can thus be seen that no significant ingress to the drive mechanism can be had by any debris such as splinters, saw dust, and the like, formed during the cutting operation. Of course, care should be taken in the construction of the bridge wall. Further, the bridge wall should not be permitted to extend upwardly to a point where it impairs either the function of the depth gauge or the cutting edge itself. It can further be seen that the relatively flat surface of the bridge wall will act as a running bearing surface for the saw chain during operation thus supplementing and complementing the function of the depth gauge 18.

The novel structure of the linking member of the present invention results in an overall simplification of the design and manufacture of saw chain assemblies. Where previously two side links were necessary to connect adjacent cutter links, now but a single such member is required. By forming the individual side walls of the linking member integrally, stamping of a single blank which can then be folded to enable such side wall to define a channel into which ends of adjacent cutter links can be disposed and secured is accomplished. The need to fabricate dual side links is thereby eliminated. The bridge wall thus formed between the side walls serves not only to block any passageway between the links to the saw drive mechanism, but also serves to maintain the side walls in substantially parallel planes with each other, separated by a predetermined distance therebetween. This greatly aids in the assembly of the saw chain by eliminating the necessity for providing means to maintain separate side links in proper position relative to each other and to the cutter links while link pins are inserted to connect the various elements to each other. The bridge wall further serves to maintain the side walls in a rigid relation to each other thus eliminating a substantial amount of shear force on the link pins which can result from individual movement of separate side links relative thereto. Elimination of such forces and, more generally, the overall reduction of moving parts effected by use of the integral unitary linking member further results in a much quieter operation of the saw chain than presently found in the prior art.

It should be understood that while this invention has been described with respect to a specific embodiment thereof, it is not to be inferred that the invention is limited thereby and it will be understood that the invention embraces all such modifications and changes in the parts and in the construction combination and arrangement of such parts as shall come within the purview of the following claims.

What is claimed is:

1. A saw chain assembly comprising a plurality of links and a plurality of linking members, hinging means connecting said links and linking members to form a chain, each pair of adjacent links being separated by a linking member and each pair of adjacent linking members being separated by a link, said links including cutting elements and gear elements, said gear elements being constructed and arranged in said chain to engage the drive mechanism of a powered chain saw, wherein each of said linking members comprises two substantially parallel side walls integrally connected by a bridge wall to define a channel between said side walls and extending the entire length thereof, and said hinging means includes means hingedly connecting one end of each of two adjacent links to said side walls and within said channel.

2. The assembly of claim 1 wherein the leading and trailing edges of said bridge wall on each linking member are substantially contiguous with adjacent links to which each said linking member is connected so that said links and said bridge wall cooperate to inhibit debris from passing between said side walls.

3. The assembly of claim 1 wherein said cutting elements and said gear elements are integral with each other.

4. The assembly of claim 2 wherein said cutting elements and said gear elements are integral with each other.

5. The assembly of claim 1 wherein said links further include depth gauge elements for controlling the cutting depth of the saw chain.

6. The assembly of claim 5 wherein said cutting elements and said gear elements are integral with each other.

7. The assembly of claim 3 wherein said links include depth gauge elements and said depth gauge elements are integral with said cutting elements and said gear elements, said depth gauge elements being operative to control the cutting depth of the cutting element integral therewith.

8. The assembly of claim 1 wherein said hinging means comprises link pins.

9. The assembly of claim 4 wherein said links include depth gauge elements and said depth gauge elements are integral with said cutting elements and said gear elements, said depth gauge elements being operative to control the cutting depth of the cutting element integral therewith.

10. The assembly of claim 9 wherein said hinging means comprises link pins.

* * * * *